United States Patent [19]

Schmid et al.

[11] 4,188,506

[45] Feb. 12, 1980

[54] METHOD AND INSTALLATION FOR MASKED SPEECH TRANSMISSION OVER A TELEPHONE CHANNEL

[75] Inventors: Pierre Schmid, Oberweningen; Eduard Brunner, Oberengstringen; Walter Stofer, Buchs, all of Switzerland

[73] Assignee: Gretag Aktiengesellschaft, Regensdorf, Switzerland

[21] Appl. No.: 688,347

[22] Filed: May 20, 1976

Related U.S. Application Data

[63] Continuation of Ser. No. 482,873, Jun. 25, 1974.

[30] Foreign Application Priority Data

Jul. 2, 1973 [CH] Switzerland ..... 9627/73

[51] Int. Cl.[2] ..... H04K 1/00; H04K 1/04

[52] U.S. Cl. ..... 179/1.5 R; 179/1.5 S

[58] Field of Search ..... 179/1.5 R, 1.5 S; 325/32

[56] References Cited

U.S. PATENT DOCUMENTS

| | | | |
|---|---|---|---|
| 1,542,566 | 6/1925 | Mathes | 179/1.5 R |
| 1,819,614 | 8/1931 | Mathes | 179/1.5 R |
| 2,411,206 | 11/1946 | Guanella | 179/1.5 R |
| 2,510,338 | 6/1950 | Guanella | 179/1.5 R |
| 3,124,748 | 3/1964 | Webb, Jr. | 179/1.5 R |
| 3,133,991 | 5/1964 | Guanella | 179/1.5 R |

*Primary Examiner*—Howard A. Birmiel

*Attorney, Agent, or Firm*—Burns, Doane, Swecker & Mathis

[57] ABSTRACT

A method and an installation for masked or scrambled speech transmission utilize a time-scrambling unit for dividing the speech band into at least two sub-bands, for delaying the one sub-band with respect to the other, and for forming an aggregate signal, and a frequency-scrambling unit for dividing the aggregate signal into at least two second sub-bands of variable band-width, for their cyclic interchanging, and for forming a transmission signal capable of being transmitted over a transmission channel, in order to mask not only the sound character of the speech signals but also the speech rhythm, thus ensuring increased privacy of transmission with high code-changing speed and low sensitivity to distortion.

26 Claims, 14 Drawing Figures

METHOD AND INSTALLATION FOR MASKED SPEECH TRANSMISSION OVER A TELEPHONE CHANNEL

Figure 1:
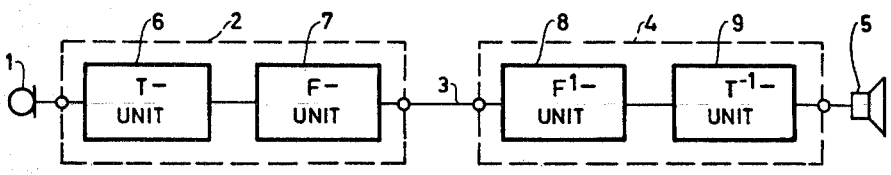

This is a continuation of application Ser. No. 482,873 filed June 25, 1974.

This invention relates to a method for the masked or scrambled transmission of spoken information over a telephone channel with the aid of control signals generated at the transmitting end and at the receiving end.

A method of masking or scrambling messages is known in which the privacy of speech transmission is achieved by adding spurious signals to the speech signals before transmission and subtracting such spurious signals from the received signal mixture after transmission. The spurious signals are obtained from an audio-frequency oscillation which is transmitted together with the speech signals. Owing to the unavoidable, frequency-dependent phase and amplitude distortions of the transmission line, the elimination of the spurious signals at the receiving end is possible only to a limited extent. For this reason, the method has not found wide acceptance in practice.

It has also been proposed that portions of the message signals to be masked be shifted in frequency by predetermined amounts before transmission and that the received signals be shifted back by the same amounts at the receiving end. The frequency shift is carried out by means of a control signal at the transmitting end and one at the receiving end. This method ensures sufficient privacy only if these control signals are variable. Hence for scrambling and unscrambling, control signals are used which are variable in accordance with an agreed program. These control signals are produced both at the transmitting end and at the receiving end by facilities which cooperate synchronously so that the transmitting-end control signal and the receiving-end control signal will be the same at any given moment in order that an intelligible message is obtained at the receiving end.

The synchronization of the two control signals can be maintained with the aid of a known arrangement where special synchronizing signals are transmitted with the masked messages in order to check the synchronization continuously. This solution is very costly. The proposal has therefore already been made that in methods where a variable signal is transmitted from the transmitting end to the receiving end, and where a control signal is derived from that variable signal both at the transmitting end and at the receiving end according to an adjustable code, the frequency shift of the message to be scrambled be controlled in transmitter by the derived control signal and the shift back be controlled in the receiver by the derived control signal.

Installations are also known in which the speech band is broken up with the aid of relatively narrow-band filters into a number of sub-bands, e.g., eight of them, and these sub-bands are then interchanged, i.e., mixed up indiscriminately, and transmitted. At the receiving end, the individual sub-bands are filtered out and put back in their original order. Such installations have an astonishingly great selection of available codes. The drawbacks of such an installation are that a large amount of equipment is necessary because n subbands require at least 2n modulators and n sub-band filters with steep sides; an additional loss of band-width is unavoidable because the band filters have only finitely steep sides; and because the band filters for the individual sub-bands are narrow-band filters, the code change-over cannot take place very rapidly due to the transients occurring, since otherwise the disturbing noises become too great.

Another known method for masking or scrambling messages to be transmitted is to divide their frequency into at least two sub-bands and to interchange these, the band-width of the sub-bands being varied by the control signals. All of these known methods have the drawback that the speech rhythm is easily recognizable in the masked signal and that a practiced third party having some experience is able to recognize the masked message at least in part.

It is an object of the invention to provide a method and an installation which make it possible to mask or scramble not only the sound character of the speech signals, i.e., their formant structure, but also the speech rhythm, i.e., the syllable and word rhythm, and to fulfill these requirements with simple means, enabling faultless operation with increased switching speed for changing the code.

A further object of the invention is to make the deciphering more difficult and to increase the insensitivity of the installation to envelope delay distortions.

To this end, in the method according to the present invention, the original speech band at the transmitting end is divided into at least two first spectral sub-bands, and the one sub-band is delayed in time with respect to the other sub-band, the signals of the sub-bands are added up to an aggreate signal, this aggregate signal is divided by means of several modulation operations into at least two second complementary sub-bands, these second sub-bands are interchanged, the ratio of the width of the second sub-bands is controlled by the control signal generated at the transmitting end, the second interchanged sub-bands are transmitted as a transmission signal over the telephone channel, the transmission signal is subjected at the receiving end to the same modulation operations as the aggregate signal at the transmitting end, the aggregate signal thereby recovered at the receiving end is divided into at least two first sub-bands, the other sub-band is delayed in time with respect to the one sub-band, and the signals of the delayed and undelayed sub-bands are added up for forming a signal which is at least similar to the original speech signal.

The installation according to the invention for carrying out of the above method, comprising two ciphering generators, one at the transmitting end and one at the receiving end, said ciphering generators each being controllable by a master generator for generating the control signal, further comprises at the transmitting end a filter device for filtering out at least two first sub-bands from the original speech band, a delay circuit for delaying the one sub-band with respect to the other one, a device for adding up the signals of the first sub-bands and for forming an aggregate signal, and a modulating means for producing two interchanged, complementary second sub-bands, lying within the band-width of the telephone channel, with variable ratio of the sub-band widths, and for generating the transmission signal for the telephone channel, and further comprises at the receiving end a demodulating means for converting the transmission signal into the aggregate signal, a filter device for dividing the recovered aggregate signal into at least two first sub-bands, a delay circuit for delaying the other first sub-band with respect to the one first sub-band, and a device for adding up the signals of the first sub-bands and for forming a signal which is at least similar to the original speech signal.

Figure 3:
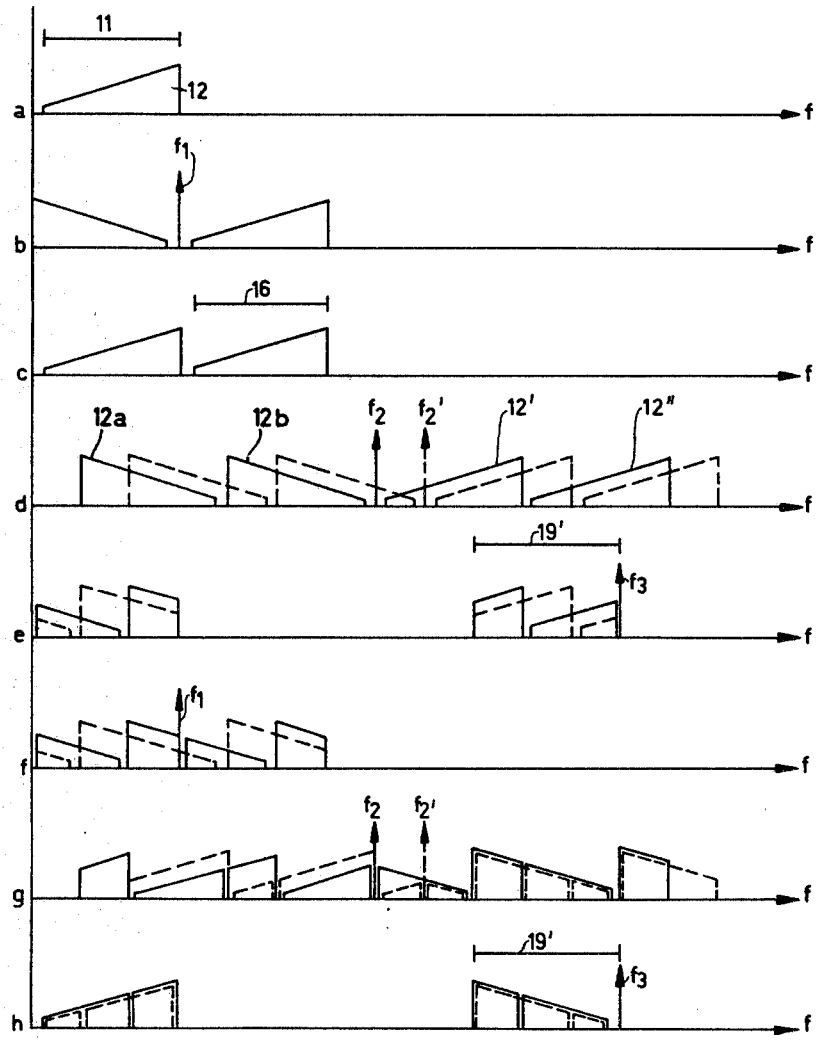
Figure 2:
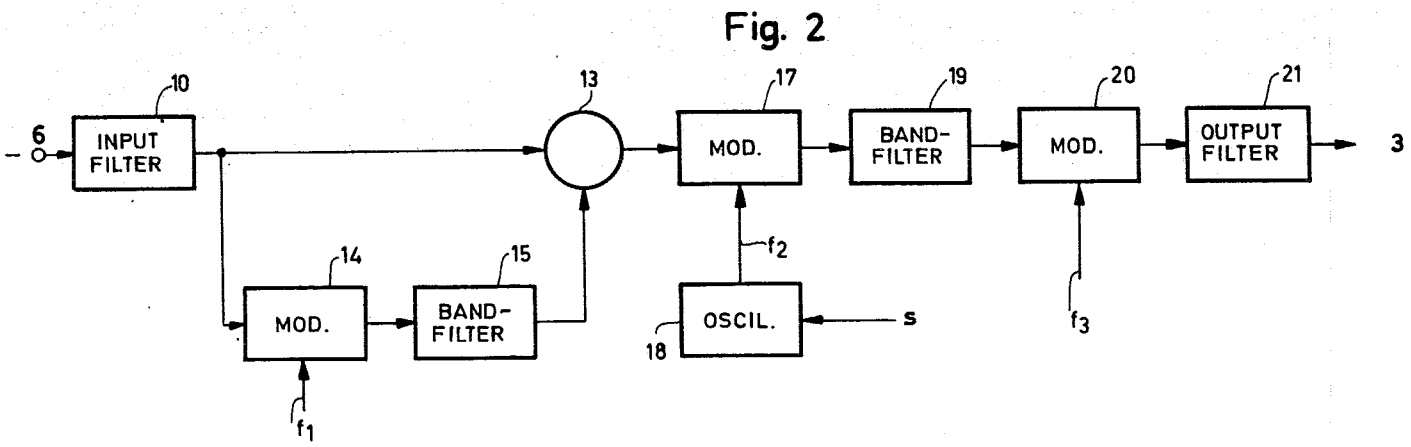
Figure 4:
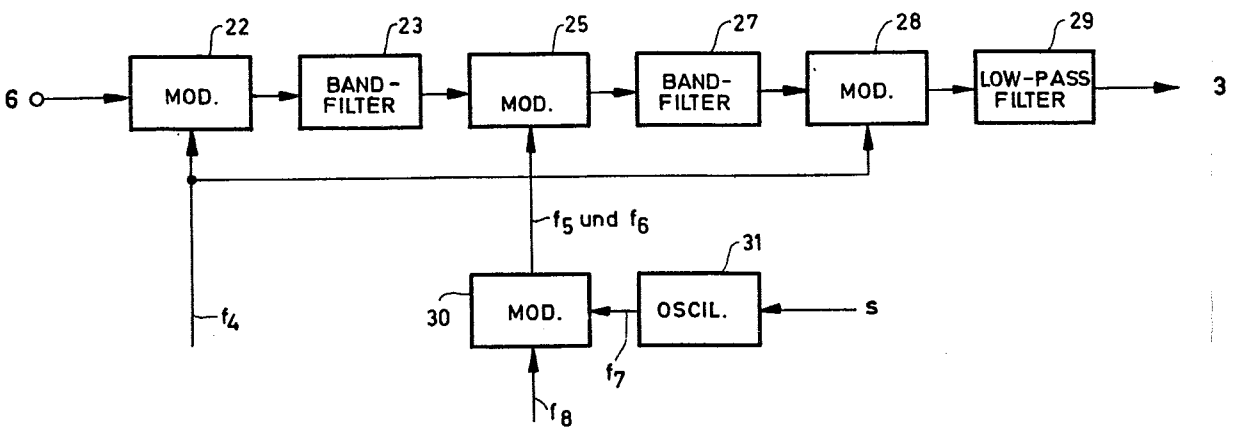
Figure 5:
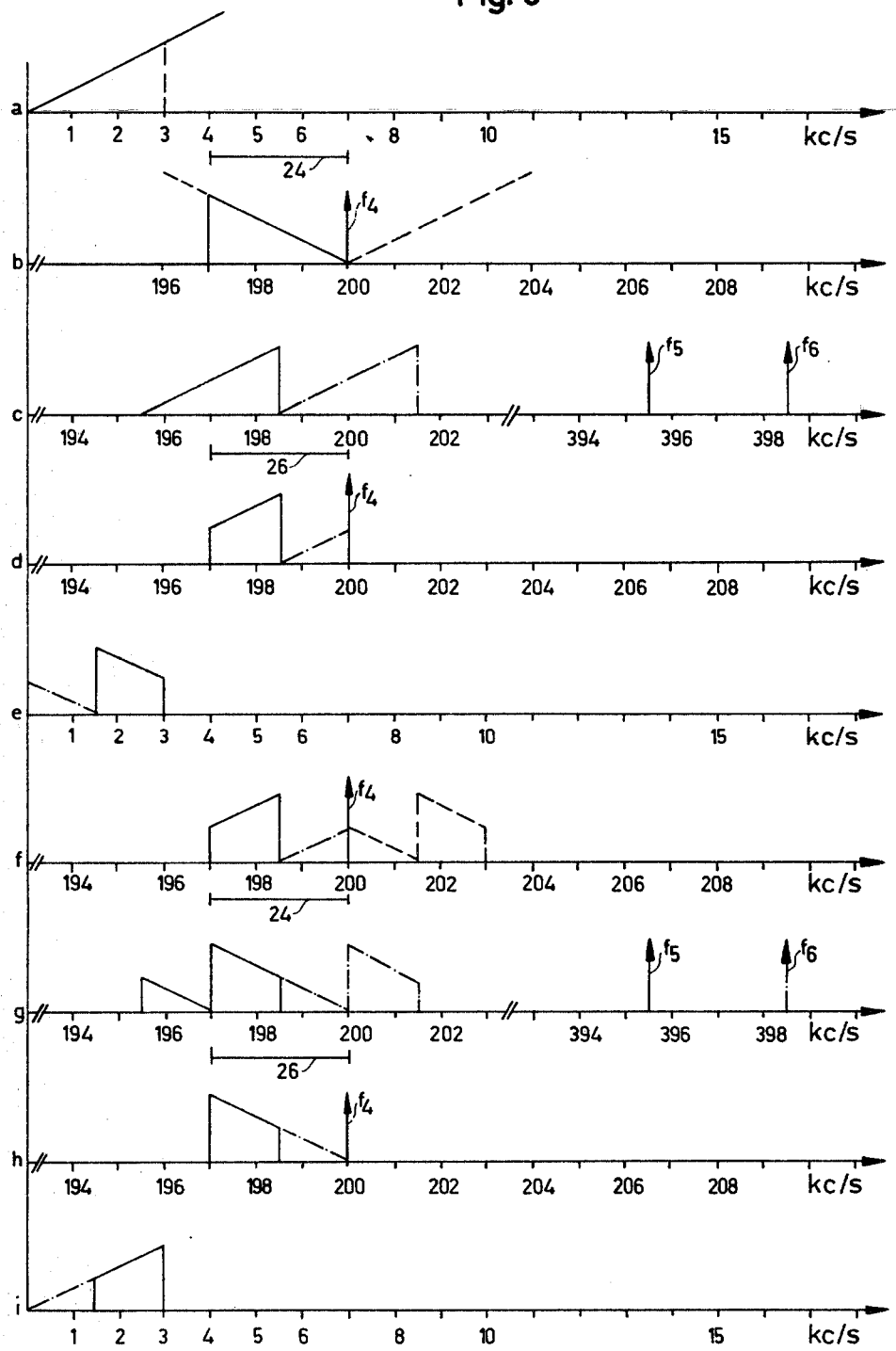
Figure 6:
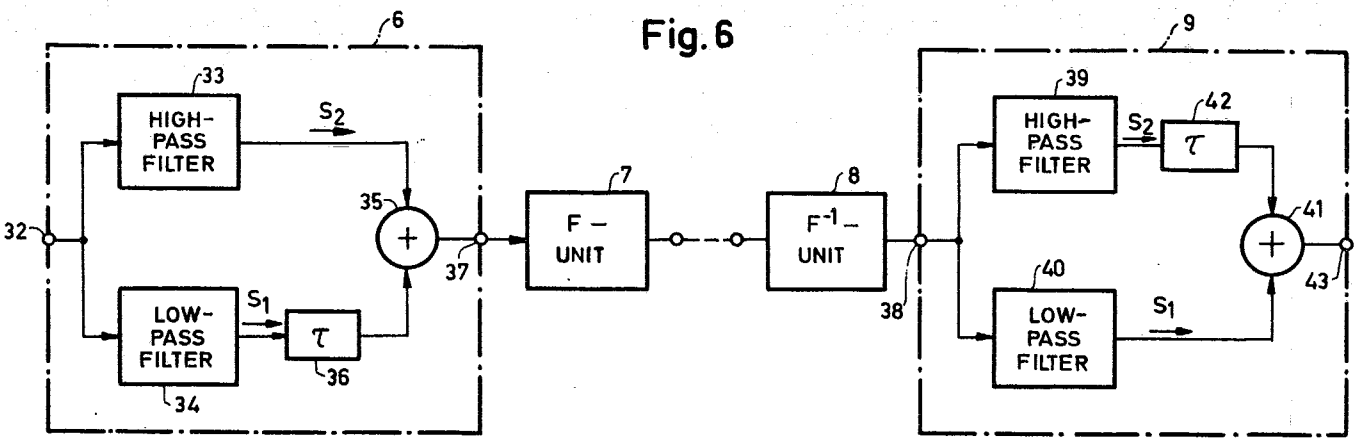
Figure 7:
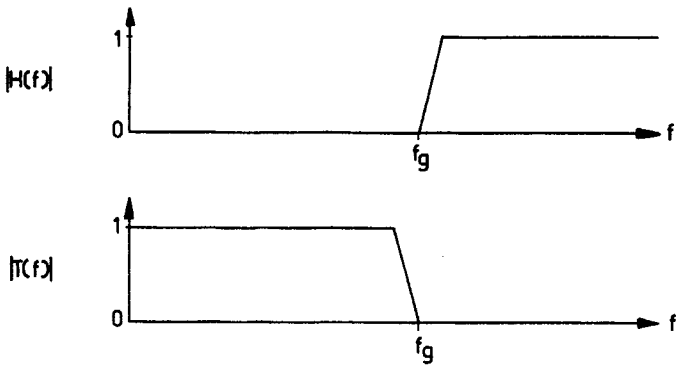
Figure 8:
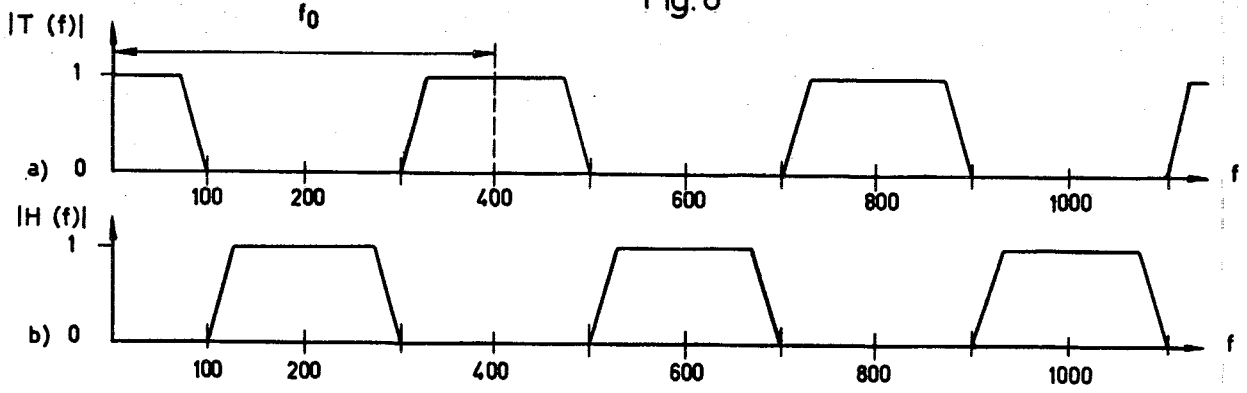
Figure 9:
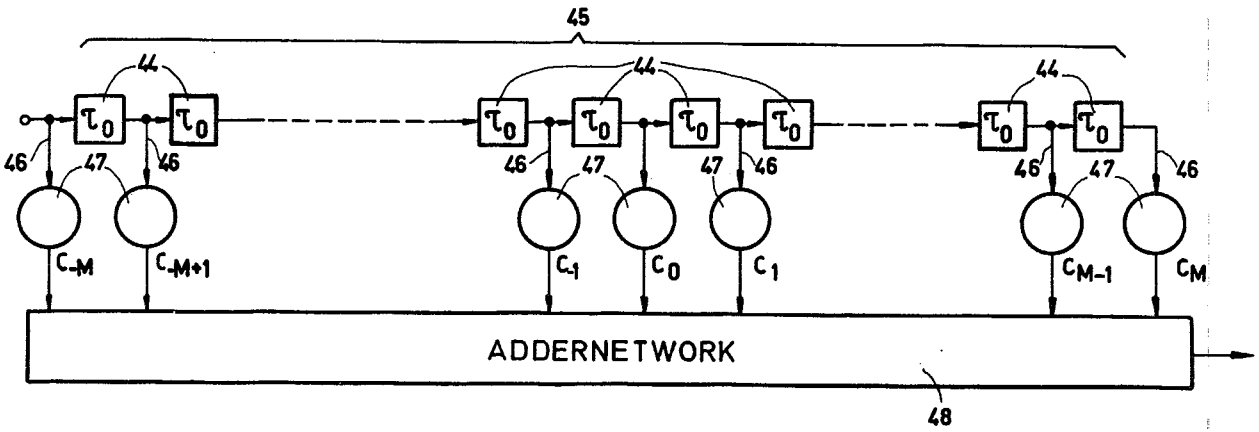
Figure 10:
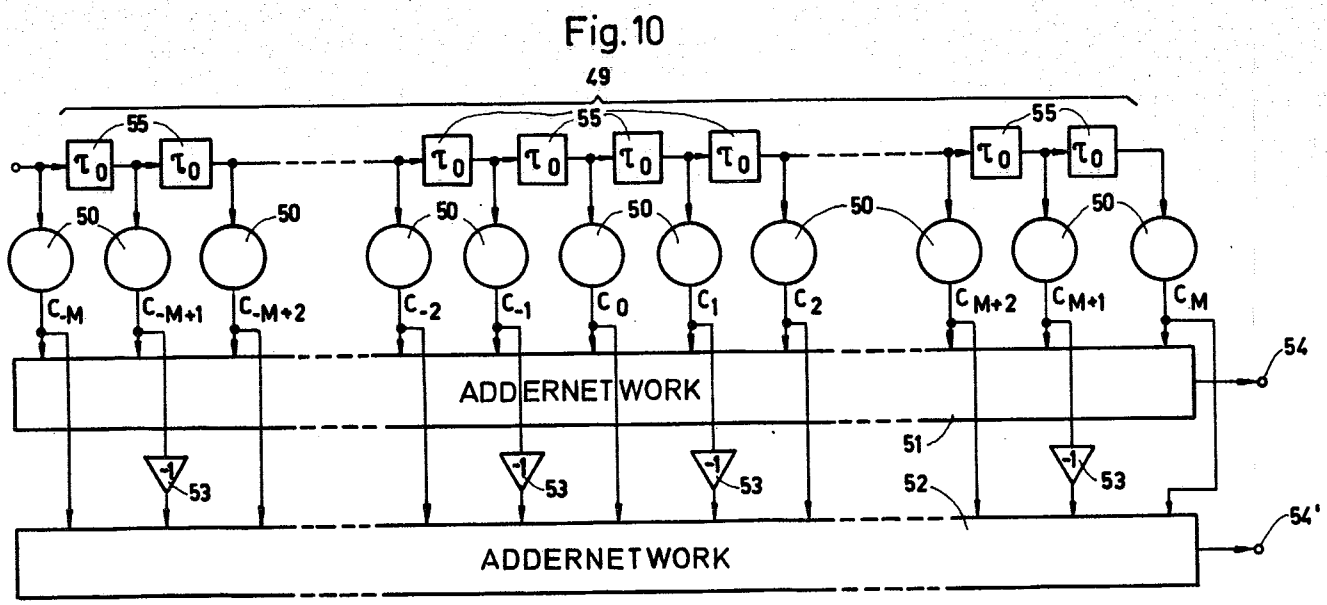
Figure 11:
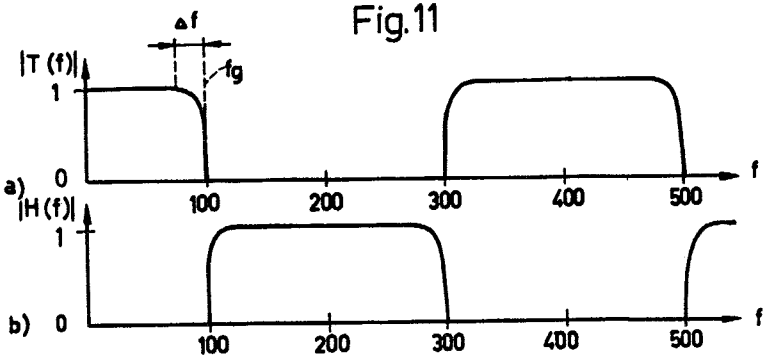
Figure 12:
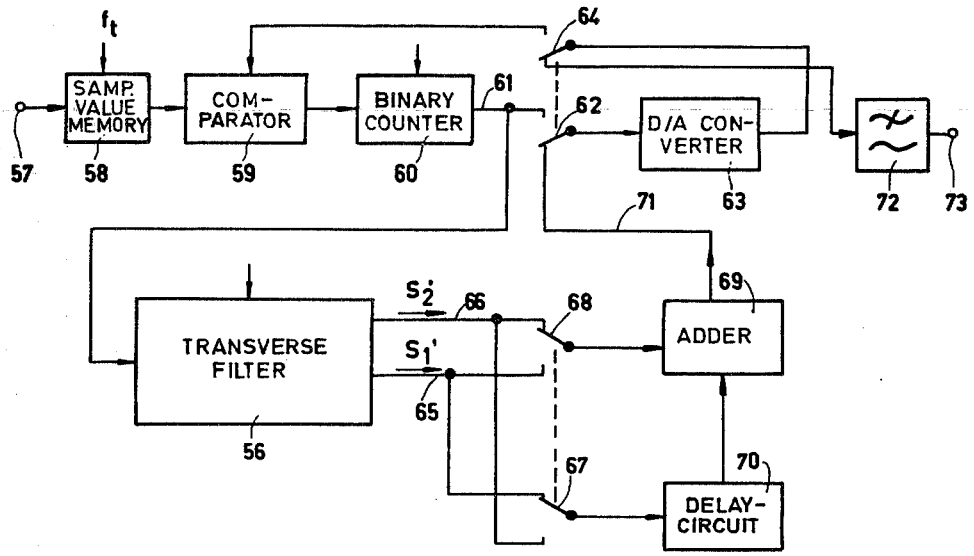
Figure 13:
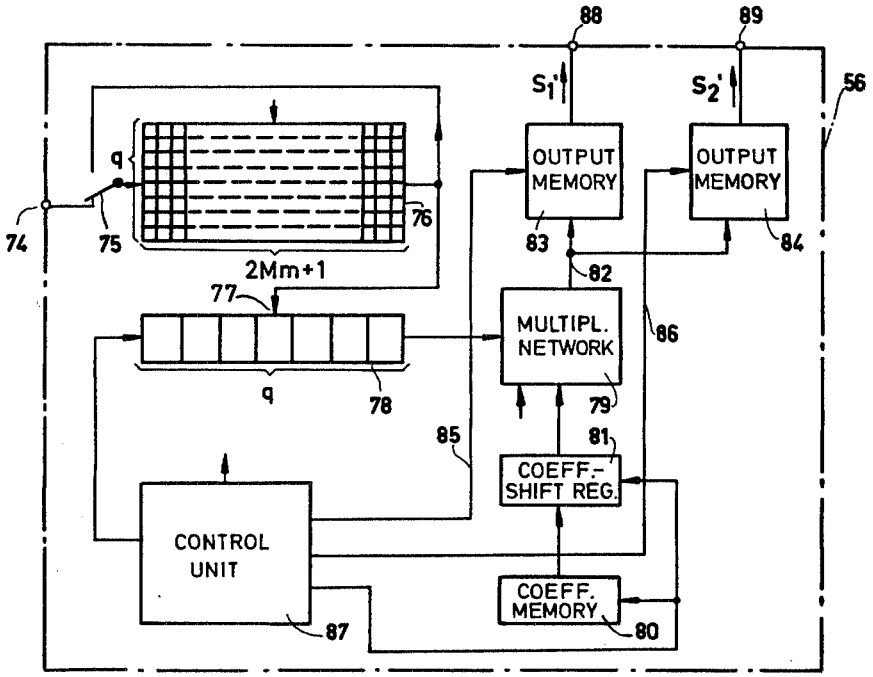
Figure 14:
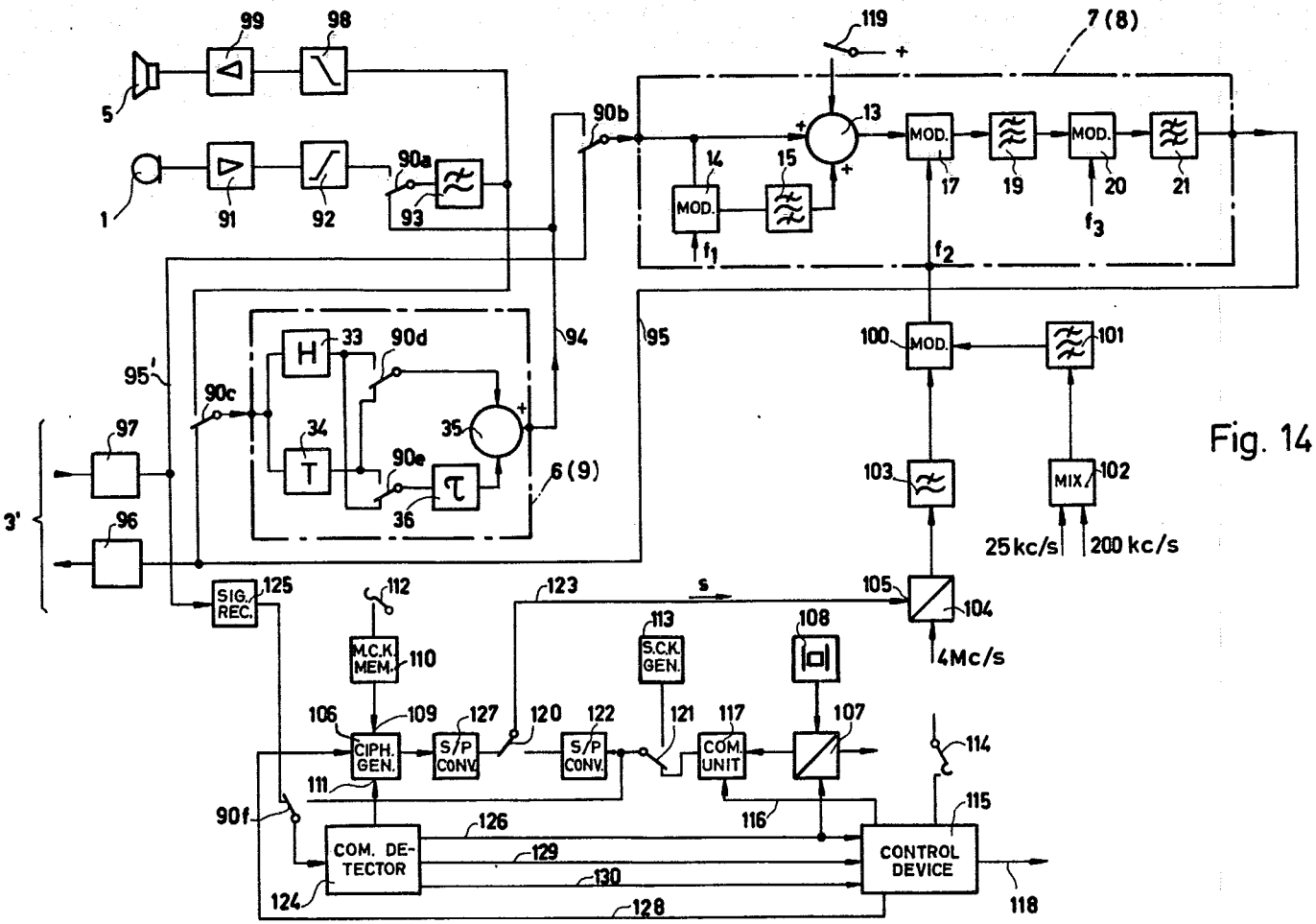

Several embodiments of the invention will now be described in detail, by way of example, with reference to the accompanying drawings, in which:

FIG. 1 shows the simplified principle of an installation for the masked or scrambled transmission of spoken information over a transmission channel, FIG. 2 is a block diagram of a unit comprised in the installation according to FIG. 1 for the cyclic shifting of the frequency band and the inversion thereof, FIG. 3 is a diagram of the mode of operation of the unit of FIG. 2, FIG. 4 is a block diagram of a further embodiment of the unit comprised in the installation of FIG. 1 for the cyclic shifting of the frequency band and the inversion thereof, FIG. 5 is a diagram of the mode of operation of the unit of FIG. 4, FIG. 6 is a greatly simplified block diagram of a unit for scrambling and unscrambling the information by means of the time-shifting of spectral sub-bands, FIG. 7 is a diagram of the pass bands of simple low- and highpass filters of the arrangement illustrated in FIG. 6, FIG. 8 is a diagram of portions of the pass bands of so-called comb filters suitable for filtering out the spectral sub-bands, FIG. 9 is a block diagram of a transversal filter serving as a comb filter, FIG. 10 is a block diagram of a circuit having two transversal filters with a common delay line, FIG. 11 is a diagram of pass bands of complementary transverse filters serving as comb filters, these pass bands having a preferred slope shape, FIG. 12 is a block diagram of a digitally produced T-scrambling unit, FIG. 13 is a block diagram of a digitally, sequentially operating, complementary transversal filter of the unit of FIG. 12, and FIG. 14 is a block circuit diagram of a station of the installation illustrated in FIG. 1.

Represented in FIG. 1 is the elementary diagram of a simple installation for the scrambled transmission of information spoken into a microphone 1 from a transmitter station 2 over a transmission channel 3 to a receiving station 4 to which an acoustic transducer 5, e.g., an earphone or loudspeaker, is connected.

In the transmitter station 2 there is a time-scrambling unit, hereinafter called T-unit 6, for dividing the speech band into at least two first sub-bands, for delaying the one sub-band with respect to the other, and for forming an aggregate signal. The transmitter station 2 further contains a frequency-scrambling unit, hereinafter called F-unit 7, for dividing the aggregate signal into at least two second sub-bands of variable band-width, for the cyclic interchanging and for the inversion thereof. At the output of the F-unit 7 appears a masked or scrambled transmission signal which is supplied to the receiving station 4 over the transmission channel 3.

The receiving station 4 possesses a frequency-unscrambling unit, hereinafter called $F^{-1}$-unit 8, for cancelling out the cyclic frequency-band interchange carried out by the F-unit 7 in the transmitter station 2, so that at the output of the $F^{-1}$-unit 8, a signal appears which is at least similar to the aggregate signal formed in the transmitter station. The receiving station 4 further possesses a time-unscrambling unit, hereinafter called $T^{-1}$-unit 9, for forming at least two first sub-bands from the aggregate signal, for delaying the other sub-band with respect to the one sub-band, and for adding up these delayed and undelayed sub-band signals, whereupon an output signal is produced which is at least similar to the speech signal produced by the microphone 1 and which is supplied to the acoustic transducer 5.

The transmission channel 3 may be any telephone channel having a band-width of, e.g., from 300–3400 c/s in accordance with the recommendations of the CCITT. This telephone channel may be a wired line, a carrier frequency channel, a radio circuit channel, or a mixed communication channel. Thus the spectrum of the scrambled transmission signal, which contains substantially all the information, may not comprise any frequencies outside the band-width of the transmission channel.

Good masking of both the sound character, i.e., the formant structure, and the speech rhythm is achieved only through the combination of the time-scrambling, with the aid of the T-unit 6, and the frequency-scrambling, with the aid of the F-unit 7, with the expenditure for the units remaining within reasonable limits. In this two-dimensional masking or scrambling method, the parameters of both the time-scrambling and the frequency-scrambling can be made variable in time by simple means. A resultant advantage is that the parameters of the time-scrambling may remain constant for a certain limited time without thereby substantially facilitating deciphering because the parameters of the time-variable frequency shift must be deciphered first, and this, moreover, is made much more difficult by the preceding time-scrambling. The signal delay between the microphone 1 and the acoustic transducer 5, caused by the time-scrambling, may be kept so short that practically no impairment of the intercommunication results.

A first embodiment of the F-unit 7 of the installation illustrated in FIG. 1 will now be described in more detail with reference to FIGS. 2 and 3. The aggregate signal generated by the T-unit 6 arrives at an input filter 10 which limits the frequency spectrum of the aggregate signal to a band of, for example, 300–3000 c/s. The pass band of this input filter 10 is indicated in line a of FIG. 3 by a line 11. Represented beneath that line is the frequency-limited band 12 which is supplied to a junction box 13, on the one hand, and to a first modulator 14, on the other hand. A carrier frequency $f_1$ is supplied to the modulator 14. A so-called ring-modulator is preferably used as the modulator 14, at the output of which only the modulation products appear, and the carrier frequency itself is greatly attenuated. The two sidebands appearing at the output of the modulator 14 are represented in line b of FIG. 3.

These two sidebands are supplied to a further band filter 15, the pass band of which is indicated by a line 16 in line c of FIG. 3. The upper sideband appearing at the output of the band filter 15 is likewise supplied to the junction box 13, so that at the output of the latter, the original speech band 12 and a speech band shifted by the amount of the carrier frequency $f_1$ appear in normal position, as shown in line c of FIG. 3.

The aggregate signal appearing at the output of the junction box 13 arrives at a second modulator 17, which is further supplied with a variable carrier frequency $f_2$ generated by a controllable oscillator 18. The upper and fewer sidebands appearing at the output of the second modulator 17, represented in line d of FIG. 3, are supplied to a band filter 19, the pass band of which is indicated by a line 19' in line e of FIG. 3. This band filter 19 allows a portion of the upper sideband to pass which contains two adjacent, frequency-shifted speech bands 12' and 12''. The limits of the pass band of the band filter 19 are such that a portion of the speech band 12' and a complementary portion of the speech band 12'' appear at the output of the band filter 19. These second sub-bands are depicted in line e of FIG. 3 beneath the line 19'.

These complementary second sub-bands are supplied to a third modulator 20 which is fed with a carrier frequency $f_3$. The modulation products appearing at the output of the third modulator 20 arrive at an output filter 21 which is essentially a low-pass filter having a critical frequency of 3000 c/s, for example. At the output of the output filter 21, the complementary second sub-bands appear in inverted position, as shown at the beginning of line e in FIG. 3.

As already mentioned, the carrier frequency $f_2$ supplied to the second modulator 17 is variable, and this as a function of a control signal s supplied to the oscillator 18. If the supplied carrier frequency is $f_2'$, for example, then the sidebands shown is dash-lines in line d of FIG. 3 appear at the output of the modulator 17. The complementary sub-bands drawn in dash-lines in line e of FIG. 3 are filtered out by the band filter 19. The range of variation of the carrier frequency $f_2$ is preferably so chosen that the borderline between the complementary second sub-bands moves back and forth in discrete steps between the upper and lower critical frequencies of the band filter 19.

The complementary second sub-bands appearing at the output of the output filter 21 in inverted position are supplied to the transmission channel 3 as a transmission signal. At the receiving station 4, a signal which is as similar as possible to that transmission signal reaches the input of the $F^{-1}$-unit 8, which may be of the same construction as the F-unit 7 described with reference to FIGS. 2 and 3. Instead of the aggregate signal generated by the T-unit 6, the transmission signal received (see the beginning of line e of FIG. 3) then arrives at the input of the input filter 10. The complementary second sub-bands and the complementary second sub-bands shifted with the aid of the first modulator 14 and the band filter 15 are then lined up in the junction box 13, as shown in line f of FIG. 3.

The signal occurring at the output of the junction box 13 is supplied to the second modulator 17, the modulation products of which are represented in line g of FIG. 3. By means of the band filter 19, the pass band of which is indicated by the line 19' in line h of FIG. 3, the speech band shown below the line 19' in inverted position is filtered out of the upper sideband. By means of the modulation operation in the second modulator 17, the choice of the pass band of the band filter 19, and the use of the same carrier frequency $f_2$ for the modulator 17 as in the transmitter station 2, the interchanged complementary second sub-bands are lined up again in their original order. To be sure, this recovered speech band is in inverted position and is supplied to the third modulator 20, which puts this speech band back in the original normal position as shown at the beginning of line h of FIG. 3. The upper sideband produced during this modulation is surpressed by the output filter 21. Accordingly, a signal which is at least similar to the aggregate signal produced by the T-unit 6 occurs at the output of the output filter 21.

The carrier frequency $f_1$ supplied to the modulator 14 generally corresponds to the maximum speech frequency to be transmitted in order that the gap between the speech bands occurring at the output of the junction box 13 may not be too great. The carrier frequencies $f_2$ and $f_3$ are adapted to the type of band filter 19 used. If a mechanical filter is used, for instance, the carrier frequencies $f_2$ and $f_3$ will preferably be on the order of 200 kc/s because the most favorable pass band of such mechanical filters is in that range.

If the magnitude of the carrier frequency $f_2$ which is supplied to the modulator 17 is such that the complementary second sub-bands of the lower sideband are filtered out by the band filter 19, the number of possible variations can be greatly increased; the complementary second sub-bands can then be transmitted alternately in normal or in inverted position, as a function of the control signal s, during the conversation to be transmitted.

A further example of an embodiment of the F-unit 7 of the installation illustrated in FIG. 1 will now be described with reference to FIGS. 4 and 5. The aggregate signals produced by the T-unit, the spectrum of which is represented in FIG. 5, line a, are supplied directly to a first modulator 22 which is fed with a relatively high carrier frequency $f_4$ of, for example, 200 ks/s. Of the two sidebands (see line b of FIG. 5) which appear at the output of the first modulator 22, the lower one is filtered out by means of a band filter 23, the pass band of which is indicated by a line 24 above line b, and supplied to a second modulator 25 acting as a multiplier. The limitation of the band-width to, for example, 3 kc/s takes place in the band filter 23. The second modulator 25 is supplied simultaneously with two carrier frequencies $f_5$ and $f_6$, which preferably differ from one another by the difference between the critical frequencies of the band filter 23 and which can be shifted by about $\pm 1.5$ kc/s relative to a nean value, the spacing between these carrier frequencies $f_5$ and $f_6$ always remaining the same. Hence two sidebands occur at the output of the second modulator 25, only the lower of which is represented in line c of FIG. 5. The upper side-band is not represented in this line because it is situated far outside the frequency range depicted. Each of these side-bands comprises two consecutive, frequency-shifted speech bands in normal position because the second modulator 25 is fed with both carrier frequencies $f_5$ and $f_6$. In the example illustrated in FIG. 5, the two carrier frequencies $f_5$ and $f_6$ are each in their central position. This position is such that the center of the lower sideband coincides with the center of the pass band (see the line referenced 26 in line d of FIG. 5) of a band filter 27. This band filter 27 filters two complementary second sub-bands out of the lower sideband, as shown in line d of FIG. 5.

According to the deflection of the carrier frequencies $f_5$ and $f_6$ from their central positions, the proportion of the one complementary second sub-band is greater or less than that of the other. The complementary second sub-bands are supplied to a third modulator 28, which is preferably fed with the same carrier frequency $f_4$ as the first modulator 22. Of the modulation products occurring at the output of the third modulator 28, only the lower sideband, shown in line e of FIG. 5 is filtered out with the aid of a low-pass filter 29. The two cyclically shifted, complementary second sub-bands are in inverted position and then arrive at the $F^{-1}$-unit 8 of the receiving station 4 over the transmission channel 3 as a transmission signal.

The two carrier frequencies $f_5$ and $f_6$ for the second modulator 25 are generated in a fourth modulator 30, which is supplied with a variable frequency $f_7$, generated by a controllable oscillator 31, on the one hand, and with a constant frequency $f_8$ of, e.g., 1.5 kc/s, on the other hand. The variable frequency $f_7$ generated by the oscillator 31 is dependent upon the control signal s supplied to the oscillator and may vary within a range of app. ±1.5 kc/s about a mean value of 397 kc/s, for example. If the fourth modulator 30 is supplied with a frequency $f_7$ of 397 kc/s and the constant frequency $f_8$ of 1.5 kc/s, for instance, then essentially the two frequencies $f_5=f_7-f_8=395.5$ kc/s and $f_6=f_7+f_8=398.5$ kc/s appear at its output. These two carrier frequencies are supplied to the second modulator 25 for forming the lower sideband represented in line c of FIG. 5.

The latter of the two above-described embodiments of the F-unit 7 of the installation of FIG. 1 offers the following advantages as compared with the first embodiment described, viz, that the input filter 10 and the junction box 13 may be dispensed with and that the band filters 23 and 27 are identical, which simplifies the manufacture of such an F-unit. For these band filters 23 and 27, mechanical filters may be used which have a low power requirement and steep sides.

The complementary second sub-bands according to line e of FIG. 5 then arrive, as already mentioned, as a transmission signal at the $F^{-1}$-unit 8 of the receiving station 4; this $F^{-1}$-unit 8 is identical to the F-unit 7 of the transmitter station 2. In the first modulator 22, the interchanged, complementary second sub-bands are modulated. The modulation product is shown in line f of FIG. 5. The lower sideband is filtered out with the band filter 23, the pass band of which is indicated by the line 24, and supplied to the second modulator 25. Drawn in line g of FIG. 5 is the lower sideband which appears at the output of the second modulator 25. The modulation with the carrier frequency $f_5$ yields the solid-line portion of the lower sideband, and the modulation with the carrier frequency $f_6$ yields the dot-dash portion of the lower sideband. The adjacent pieces of the aforementioned sideband portions yield a complete, frequency-shifted speech band in inverted position again, which is filtered out with the band filter 27 and supplied to the third modulator 28. In the latter, the aggregate signal is put back into the original position (see line i of FIG. 5) and then reaches the $T^{-1}$-unit 9 via the low-pass filter 29.

With the two F-units described above, the parameter of the frequency-masking can be changed by switching between discrete frequency-shifts at a relatively high switching speed, e.g., 50 switches per second.

If the speech signals produced by the microphone 1 were supplied to the input of the F-unit 7 directly, the signals appearing at the output of the low-pass filter 29 or of the output filter 21 of the above-described F-units would occur in the rhythm of the speech spoken into the microphone 1. This recognizable speech rhythm could give an unauthorized third party valuable indications for deciphering the message. In order to prevent this, the T-unit 6 described below is inserted before the F-unit 7 in the transmitter station 2, and the $T^{-1}$-unit 9 is inserted after the $F^{-1}$-unit in the receiving station 4.

Described below is the basic mode of operation of a simple type of the time-masking (T- and $T^{-}$-units) with the aid of two sub-bands delayed with respect to one another. Basic circuits for producing two time-shifted sub-bands and for forming the aggregate signal which is supplied to the F-unit 7 are described with reference to FIGS. 6 and 7.

FIG. 6 shows, among other things, a block diagram of a simple T-unit 6 and a $T^{-1}$-unit 9. The speech signal produced by the microphone 1 is supplied to an input terminal 32 and from there reaches the input of a high-pass filter 33 and the input of a low-pass filter 34. The high-pass filter 33 with the complex transmission function H (f) and the low-pass filter 34 with the complex transmission function T (f) are so laid out that their pass bands are complementary to one another, as is illustrated in FIG. 7 for the case of a simple example. What is essential is that the pass bands do not overlap because this would lead to interfering signal portions in the desired signal.

At the output of the high-pass filter 33 there appears the signal $S_2$, which is supplied directly to an adder 35. This signal contains all spectral portions of the original which lie within the pass band of the high-pass filter 33, i.e., in the above-mentioned example of FIG. 7, all frequency components above the critical frequency $f_g$. At the output of the low-pass filter 34 there appears the signal $S_1$, which is supplied to the adder 35 via the delay circuit 36. This signal contains the spectral portions of the original which lie within the pass band of the low-pass filter 34, i.e., in the above-mentioned example of FIG. 7, all frequency components below the critical frequency $f_g$. In the delay circuit, the signal $S_1$ is delayed by the time $\tau$. At the output of the adder 35, which is connected to an output terminal 37, the aggregate signal appears, which then reaches the input of the F-unit 7.

At the receiving end, the aggregate signal recovered at the output of the $F^{-1}$-unit 8 is supplied to an input terminal 38 of the $T^{-1}$-unit 9. This aggregate signal reaches the inputs of a high-pass filter 39 and a low-pass filter 40 parallel. These two filters have the same characteristics as those of the T-unit 6. The aggregate signal is thereby split up into the same spectral portions $S_1$ and $S_2$ as in the T-unit. The signal $S_1$ appears at the output of the low-pass filter 40 and is supplied directly to an adder 41. The signal $S_2$ appears at the output of the high-pass filter 39 and is supplied to the adder 41 via a delay circuit 42. The two complementary spectral portions $S_1$ and $S_2$ appear again simultaneously at an output terminal 43 of the $T^{-1}$-unit 9 and form the aggregate signal which is at least very similar to the speech signal originally supplied to the input terminal 32 of the T-unit 6. This aggregate signal is then supplied to the acoustic transducer 5.

During transmission, the signal $S_1$ is delayed at the transmitting end with respect to the signal $S_2$ by the time $\tau$, and at the receiving end the signal $S_2$ is delayed with respect to the signal $S_1$ by the same time $\tau$, so that the entire signal is totally delayed by the time $\tau$. Added to this delay is, as the case may be, the delay of the signals in the filters 33 and 39, and 34 and 40. An optimum scrambling effect is achieved when the delay time $\tau$ is on the order of from 100–500 ms.

The complementary filter characteristics T (f) and H (f) are preferably such that the average power of the speech signal is divided approximately equally between the two spectral portions $S_1$ and $S_2$. In this way, in combination with an F-unit in accordance with FIG. 1, an effective masking of the speech rhythm is obtained through the described T-unit, the deciphering of the F-masking by unauthorized persons being made substantially more difficult at the same time.

A particularly effective scrambling effect is achieved when the transmission characteristics of the filters 33, 34, 39, and 40 are as shown in principle in FIG. 8. The filters 34 and 40 have the pass bands depicted in line a of FIG. 8 and the filters 33 and 39 those depicted in line b. It will be seen from FIG. 8 that the pass bands are disposed in a comb-like manner, the pass bands of the two different filters being so disposed that the pass bands of the one filter fall in the stop bands of the other filter. It is to be heeded in this connection that the individual pass bands of the two filters do not overlap. Filters having pass bands in accordance with lines a and b of FIG. 8 are referred to hereafter as complementary comb-filters.

An especially good scrambling effect is achieved when the period $f_o$ of the frequency response of the comb-filters is on the order of double the pitch frequency of the speech, e.g., between 200 and 500 c/s, so that insofar as possible, no directly adjacent pitch harmonic frequencies of the spectrum of voiced sounds find their way into the same channel. The analysis of the masked transmission signal is thereby made extremely difficult for unauthorized persons. In the case of the transmission characteristics of the comb-filters represented only partially in FIG. 8, the period $f_o$ is 400 c/s. Line a shows the function $|T(f)|$, and line b shows the function $|H(f)|$. Such transmission functions or comb-filter characteristics may be obtained with so-called transversal filters.

A block diagram of such a transversal filter is represented in FIG. 9. It has a delay line 45 composed of individual delay circuits 44. The delay time $\tau_o$ by which each of the delay circuits delays the signal supplied to it is $$\tau_o = 1/f_o$$

$f_o$ being the period of the frequency response. Each tapping point 46 of the delay line 45 is connected via an associated transfer element 47 to an adder network 48. The coefficients of the transversal filter, which are the coefficients $C_{-M}$, $C_{-M+1} \ldots C_{M-1}$ and $C_M$ of the transfer elements 47, may be determined as a Fourier transform of the transmission function of the respective filter. If the coefficients of the low-pass comb-filter are designated as $$C_{T\,k} \text{ with } k = -M \ldots +M$$

and the coefficients of the high-pass comb-filter are designated as $$C_{H\,k} \text{ with } k = -M \ldots +M$$

then without overlapping of the pass bands, the following simple relationship can be derived for the coefficients of complementary low-pass and high-pass comb-filters, the pass bands of which are represented in FIG. 8:

$C_{T\,k} = C_{H\,k}$—for k as an even number, incl. 0

$C_{T\,k} = -C_{H\,k}$—for k as an odd number. Thus the even-number coefficients are the same for both filters, and the odd-number coefficients are inveribly equal.

Hence it is possible to use two transversal filters, viz., the one with the transmission function T (f) and the one with the transmission function H (f), with a common delay line 49 and with transfer elements 50 used in common. Such a circuit is illustrated in FIG. 10. The outputs of all transfer elements 50 are connected to a first adder network 51, the outputs of the even-numbered transfer elements 50 are further connected to a second adder network 52, and the outputs of the odd-numbered transfer elements 50 are connected via one inverter 53 each to the second adder network 52. The signal $S_1$ is taken off at an output terminal 54 connected to the output of the first adder network 51, and the signal $S_2$ is taken off at an output terminal 54' connected to the output of the second adder network 52.

In the case of the absolute values of the transmission functions T (f) and H (f) represented in lines a and b of FIG. 8, the shape of the slopes of the individual pass bands is idealized. In order to indicate that the pass bands are not supposed to overlap, the slopes of the filter curves have been drawn slightly slanted. The length of the transversal filter, which in practice is finite, determines the quality of the approximation of the given frequency response. For this reason, it is advantageous to provide for frequency responses with cosinusoidal slopes, as may be seen in FIG. 11, rather than the idealized ones shown in FIG. 8. Here, too, it is a prerequisite that no overlapping of the pass bands should take place. Experiments have shown that good results are obtained using cosinusoidal slopes with a relative steepness of $$\delta = (\Delta f / f_g) \approx 0.1$$

as defined in FIG. 11. Transversal filters with $(2M+1) = 31$ transfer elements 50 result in a sufficiently good approximation of such comb-filter characteristics.

The above-described method of scrambling and unscrambling the speech signal on the time axis is relatively insensitive to time-variable phase distortions to which the transmission signal is exposed during the transmission because no compensation of the delayed, added component signal in proper phase relation is necessary. The insensitivity of speech signals to envelope delay distortions is exploited with this method.

The disturbing influence of greater frequency shifts, as may occur during transmission of the transmission signal over a carrier-frequency telephone channel or a single-sideband radio channel, for instance, can be eliminated with the aid of a simultaneously transmitted pilot tone.

The designs of complementary comb-filters in accordance with FIG. 10 may differ in practice particularly in the way in which the delay line 49 is constructed. In a first example of an embodiment, this delay line may be an capacitive analog shift register, a so-called "bucket-brigade" memory, which shift register has at each of its tapping points an analog multiplier, the analog output signals of which are supplied to an analog summer. According to another embodiment, a digital shift register may be used as the delay line. In this case, the multiplication of the digital values appearing at the tapping points by the filter coefficients preferably takes place sequentially. In this way, only one multiplier is necessary.

In both cases, a sampled signal is supplied to the delay line. According to the sampling theorem, the sampling frequency $f_t$ must correspond to at least double the band-width B of the speech signal, i.e., $$f_t \geqq 2B.$$

Thus $$\tau_o f_t = (f_t/f_o) = m \text{ sampling pulses}$$

occur during the delay period $\tau_o$ between two adjacent tapping points of the delay line 49, $f_t$ being the sampling frequency and $f_o$ being the period of the frequency response of the comb-filters. If need be, $f_o$ and $f_t$ are to be so adapted that the number m of sampling pulses becomes a whole number. If the comb-filters having a complementary, periodical frequency response are produced by means of a shift register, then m individual storage locations are to be provided for each of the delay circuits 55 of the delay line 49.

It is expedient for the signal $S_1$ to be delayed by the delay time $\tau$ at the transmitting end and for the signal $S_2$ to be delayed by the delay time $\tau$ at the receiving end by means of a similar shift register as well, i.e., by a capacitive analog shift register or a digital shift register with which the comb-filter is constructed.

Since the information is sampled in the foregoing embodiments of comb-filters, the parameters of the time-scrambling, i.e., the comb-filter characteristics and the delay time $\tau$, can be time-varied in a simple manner in these embodiments by varying the pulse frequency with which the shift pulses are supplied to these analog or digital shift registers. In a preferred embodiment, the pulse frequency can be switched between discrete values at certain time intervals by means of a further control signal derived from a ciphering generator; the delays of the individual spectral portions $S_1$ and $S_2$ of the signal in the delay circuits 36 and 42 and in the filters 33, 34, 39, 40 must then be taken into consideration. In this case, it may be expedient under certain circumstances to invert the order of the high-pass filter 39 and the delay circuit 42 in the $T^{-1}$-unit of FIG. 6.

FIG. 12 shows a block diagram of an embodiment of the T-unit 6, or the $T^{-1}$-unit 9, which carries out the time-scramblind, or unscrambling, with the aid of a transversal filter 56 containing digital shift registers. The basic construction of this transversal filter is shown in more detail in FIG. 13.

The analog speech signal is supplied to an input terminal 57, and the analog aggregate signal is taken off at an output terminal 73. The formation of the signal $S_1'$ corresponding to the transmission function T (f) and of the signal $S_2'$ corresponding to the transmission function H (f), the delaying of the signal $S_1'$, and the addition of the signal $S_2'$ and the delayed signal $S_1'$ takes place digitally. A comparator 59, a binary counter 60, and a digital-to-analog converter 63 serve as an analog-to-digital converter which converts the analog speech signals into digital signals which are supplied to the transverse filter 56. The digital aggregate signal occurring at the output of an adder 69, i.e., on a multi-wire line 71, is converted back into an analog aggregate signal in the digital-to-analog converter 63. Thus the digital-to-analog converter 63 is used in the time-division multiplex both for the analog-to-digital conversion of the input signals of the T- and $T^{-1}$-units and for the digital-to-analog conversion of the time-scrambled and -unscrambled signals. The individual operations will now be described in more detail.

The analog speech signal produced by the microphone 1 is supplied to a sampling value memory 58 via the input terminal 57 for sampling and for short-term storage of the analog sampling values. The first analog sampling value then reaches the comparator 59, the output signal of which is supplied to the input of the binary counter 60. Connected to the outputs of the binary counter 60 is a multi-wire line 61 which supplies the q parallel outputs of the binary counter 60 to the digital-to-analog converter 63 via q electronic, parallel-operated switches, represented symbolically by one switch 62, which is at this moment in the position not shown in FIG. 12. The analog output signal appearing at the output of the digital-to-analog converter 63, corresponding to the binary value in the counter, is fed back to the comparator 59 via a further electronic switch 64 which is controlled synchronously with the electronic switch 62. The binary counter 60 continues to count until the comparator 59 determines that the signal supplied to it from the digital-to-analog converter 63 is equal to the analog sampling value supplied to the comparator 59 from the sampling value memory 58. When these two values are equal, the binary counter 60 is stopped, and the binary digits appearing at its q parallel outputs, which correspond to a samling value, are supplied parallel over the multi-wire line 61 to the transversal filter 56. Simultaneously with the stopping of the binary counter 60, the electronic switches 62 and 64 are switches into the position shown in FIG. 12.

The information supplied to the transversal filter 56 in digital form is processed therein, in a manner described below with reference to FIG. 13. The digital signals $S_1'$ and $S_2'$, consisting of q parallel bits per sampling value and corresponding to the above-mentioned signals $S_1$ and $S_2$, appear at two output lines 65 and 66, each composed of q wires. The signals $S_1'$ and $S_2'$ are then supplied via switches 67 and 68, respectively, each of which are q electronic, parallel-operated switches, either directly to the adder 69 or via a delay circuit 70 to the adder 69. The switches 67 and 68 serve to switch the mode of operation of the unit represented in FIG. 12 from time-scrambling to time-unscrambling or vice versa.

In the case of scrambling, the digital signal $S_2'$ of the output line 66 is added in the adder 69 to the digital signal $S_1'$ delayed in the delay circuit 70, and the digital aggregate obtained in this manner is supplied parallel over a multi-wire line 71 and via q electronic, parallel-operated switches, represented by 62, to the digital-to-analog converter 63. The individual analog sampling values of the aggregate signal appearing at the output of the digital-to-analog converter 63 are fed on via the electronic switch 64 to a low-pass filter 72 and thereafter, in the case of time-scrambling, via an output terminal 73 to the F-unit 7.

When the unit illustrated in FIG. 12 serves as the $T^{-1}$-unit 9, i.e., when the switches 67 and 68 are not in the position shown in FIG. 12, then the analog aggregate signal is supplied to the input terminal 57, and the recovered analog speech signal is taken from the output terminal 73. The reversal of the switches 67 and 68 causes the signals $S_1'$ to be supplied directly to the adder 69 and causes the signal $S_2'$ to be supplied to the adder 69 via the delay circuit 70. The time-shifting of the signal $S_1'$ with respect to the signal $S_2'$, carried out at the transmitting end, is thereby cancelled, but with the entire transmitted speech signal having been delayed by the value $\tau$ of the delay circuit 70 and the signal transit time through the filters.

FIG. 13 is a block circuit diagram of the digitally, sequentially produced complementary transversal filter 56 of the unit illustrated in FIG. 12. Via q parallel input terminals 74, which are symbolically represented by a single one, the digital information of q bits of a sampling value are supplied parallel via a q parallel-operated switches, represented by 75, to a shift register 76 at the cadence of the sampling frequency $f_t$. Between the individual sampling moments, the switches 75 are not in the position shown in FIG. 13. The shift register 76 comprises a number of parallel channels corresponding to the number q of input terminals 74; each such channel has (2 Mm+1) storage locations, 2 M representing the number of elementary delays $\tau_o$, and m the number of sampling pulses per elementary delay $\tau_o$ in accordance with FIGS. 9 and 10, respectively. The q outputs of the shift register 76 (q bits parallel) are connected to the q switches 75 and to a buffer memory 78. During the length of a sampling pulse corresponding to $T=1/f_T$, the (2 Mm+1) sampling values stored in the shift register 76 are multiplied sequentially by the 2 (2 M+1) coefficients of the low-pass and high-pass filters from a coefficient memory 80. For this purpose, the sampling values in the shift register are cyclically shifted twice by 2 (2 Mm+1) shift clock pulses, the switches 75 being in the position not shown. After every m shift clock pulses, a sampling value (q bits parallel) is taken over into the buffer memory 78, which preferably takes the form of a q-bit shift register with q inputs, represented by 77, and a sequential output. After 2 (2 Mm+1) shift clock pulses, all 2 (2 M+1) multiplications of the stored sampling values in the shift register 76 by the corresponding coefficients have taken place, as will be described in more detail below. Hence upon the next shift clock pulse, the switches 75 can be thrown into the position shown in FIG. 13, and upon the sampling pulse which takes place simultaneously, a new sampling value can be introduced into the shift register 76. At the same time, the sampling value which is behind by the delay of (2 Mm+1) T is eliminated from the shift register 76. Thereafter, the switches 75 are put back in the position not shown in FIG. 13, and the above-described cyclic shifting operation is repeated anew.

The digital information of the individual sampling values stored in the buffer memory 78 reaches a multiplier network 79. To this multiplier network 79 there is supplied a coefficient stored in the coefficient memory 80, which is a read-only memory, which coefficient has been transferred to a coefficient shift register 81. In the multiplier network 79 the digital information concerning the sampling value, obtained from the buffer memory 78, is then multiplied by the selected coefficient, and the product reaches a first output memory 83 and a second output memory 84 via a multiple line 82. Each of the output memories 83 and 84 is connected by a control line, 85 and 86, respectively, to a control unit 87, and the output memories do not take over the products which have reached their inputs from the multiplier network 79 until called upon to do so by the control unit 87 via the control lines 85 and 86.

The operations performed simultaneously by the transfer elements 50 and the inverter 53, shown in FIG. 10, are performed by the single multiplier network 79 in the same amount of time, but very quickly one after the other, i.e., sequentially. The output memory 83 assumes the function of the adder network 51, and the output memory 84 assumes the function of the adder network 52. All the parts sequentially computed for each sampling value of the digital signal $S_1'$ by the multiplier network 79 are cumulated in the output memory 83. The digital signal $S_1'$ then reaches the delay circuit 70 and then the adder 69, in parallel form, via output terminals 88, symbolically represented by a single one, and via the multi-wire output line 65, and in the case of time-scrambling, via the switches 67 (see FIG. 12). All the parts sequentially computed for each sampling value of the digital signal $S_2'$ by the multiplier network 79 are cumulated in the output memory 84. The digital signal $S_2'$ reaches the adder 69 directly over output terminals 89, the multi-wire output line 66, and in the case of time-scrambling, over the switches 68.

All of the above-mentioned parts of the transverse filter 56 are controlled by the control unit 87, the pulse frequency of the shift pulses for the shift register 76, the buffer memory 78, and the coefficient shift register 81 being substantially higher than the pulse frequency of the sampling pulses supplied to the sampling value memory 58.

The delay line 49 of the complementary comb-filter according to FIG. 10 may be a capacitive analog shift register capable of storing analog values. Such capacitive analog shift registers are known by the name of bucket-brigade memories. The sampling values of the input signals are stored in capacitors in the form of charges, and the individual charges in the capacitors are passed on to the next capacitors by transistors acting as switches. Analog component signals are taken from the tapping points of the delay line 49, and the transfer members 50 are simple analog multipliers, possibly amplifiers, which multiply the analog component signals by the corresponding coefficients associated with the respective tapping points. The analog component signals multiplied by the coefficients are then added up in an analog adder network to form the analog aggregate signal.

The use of a capacitive analog shift register as the delay line makes it possible to couple the tapping points capacitively to the corresponding capacitors, each representing a storage location. Through a suitable choice of the capacitors, it can be achieved that the analog component signals occurring at the tapping point are already multiplied by the corresponding coefficients. These multiplied, analog component signals can then be supplied directly to the analog adder network. The delay circuits 36 and 42 for delaying the signals $S_1$ and $S_2$, respectively, according to FIG. 6, can naturally also be produced with capacitive analog shift registers.

When the delay line of the comb-filter and the above-mentioned delay circuits contain analog or digital shift registers, it is possible to vary the parameters of the time-scrambling, such as the comb-filter characteristic and the delay time $\tau$, by time-varying the sampling frequency $f_t$, whereby deciphering presents added difficulty.

FIG. 14 is a block diagram of a station of the installation described above. This station can be switched from receiving to transmitting operation and vice versa with the aid of a six-pole switch assembly 90*a*–90*f*. Two such stations make up a complete installation for the masked or scrambled transmission of speech signals. The TR switches 90*a*–90*f* shown in FIG. 14 are in the receiving position.

Let it be assumed first, howevver, that these TR switches have been switched to transmitting in a manner to be described below. The analog electric speech signals produced by the microphone 1 are amplified with gain control in a microphone amplifier 91 and supplied via a preemphasis network 92, the TR switch 90*a*, a low-pass filter 93, and the TR switch 90*c* to the unit 6 or 9, acting in transmitting condition as the T-unit 6. This unit is similarly constructed to that described above with reference to FIG. 6. For this reason, similar parts are designated by the same reference numerals. The only difference is that the TR switches 90d and 90e are disposed between the outputs of the high-pass filter 33 or the low-pass filter 34, on the one hand, and the one input of the adder 35 or the delay circuit 36, on the other hand. In the position of the TR switches shown in FIG. 14, the T-unit 6 or 9 serves for time-unscrambling, and in the position of the TR switches not shown, it serves for time-scrambling. Going on the above assumption that the TR switches are in the position not shown, the analog, band-limited speech signal reaches the two filters 33 and 34, which may also be comb-filters. The signal $S_2$ appearing at the output of the high-pass filter 33 then reaches the adder 35 directly via the TR switch 90d, whereas the signal $S_1$ appearing at the output of the low-pass filter 34 is supplied to the delay circuit 36 via the TR switch 90e, and only thereafter reaches the adder 35, delayed by the time $\tau$. The aggregate signal occurring at the output of the adder 35 is supplied via a line 94 and the TR switch 90b to the unit 7 or 8, acting in transmitting condition as the F-unit 7. This unit is described above in detail by way of example with reference to FIG. 2, and those parts which perform the same functions are designated with the same reference numerals. The transmission signal appearing at the output of the unit 7 or 8 is supplied via a line 95 to an adapting network 96, which may, for example, be connected to the AF input of a radio station forming part of the wireless transmission channel 3'.

The signal transmitted over the transmission channel 3' is received at the opposite station, which is identical to the station illustrated in FIG. 14. Via an adapting network 97, the masked or scrambled transmission signal received reaches the unit 7 or 8, acting as the $F^{-1}$-unit 8, over a line 95' and the TR switch 90b, which, when the station is receiving, is in the position shown. In this $F^{-1}$-unit 8, the frequency-band shift and inversion carried out at the transmitting station are cancelled, and there appears at the output of the unit 7 or 8 the aggregate signal generated in the transmitting station, which signal reaches the unit 6 or 9 over the line 95 and the TR switch 90c. This unit now acts as the $T^{-1}$-unit 9, i.e., the signal $S_2$ is delayed in it with respect to the signal $S_1$, and the signal appearing at the output of the adder 35 substantially corresponds to the analog speech signal produced by the microphone 1 in the opposite station. The signal appearing at the output of the adder 35 is supplied via the line 94, the TR switch 90a, the low-pass filter 93, a deemphasis network 98, and a final amplifier 99 to the acoustic transducer 5.

As explained above with reference to FIGS. 2–5, a carrier frequency $f_2$, or carrier frequencies $f_5$ and $f_6$, dependent upon the control signal s, is supplied to the second modulator 17, or 25, of the F-unit or $F^{-1}$-unit, in order that the complementary sub-bands shift in discrete time steps as a function of this control signal. The control signal s in the transmitting station must obviously correspond exactly to the control signal s in the receiving station if the frequency-band shift and inversion are to be cancelled completely.

The variable carrier frequency $f_2$ for the second modulator 17 is generated with the aid of a modulator 100, which is supplied on the one hand with a frequency of, e.g., 175 kc/s from a band filter 101 which filters this frequency out of the frequency mixture produced by a mixer 102 in that the two frequencies 25 kc/s and 200 kc/s are supplied to this mixer; and on the other hand from a low-pass filter 103 with a frequency which is discretely variable by a controllable frequency divider 104, the duration of the scrambling intervals preferably being from 20–100 ms.

The digital control signal s is supplied to the five parallel inputs 105 of the controllable frequency divider 104, which are symbolically represented by a single input. This control signal s is generated by a ciphering generator 106, and each control signal s may, for example, comprise five bits which reach the individual inputs 105 parallel. Each control signal s is stored in the frequency divider 104 until a new control signal s has arrived, and represents a numerical value of from 0–31. Consequently, the division factor t of the frequency divider 104 may, for example, assume 15 different values in the range of from 184–212 according to the control signal s when only even-numbered division factors t are permitted. For masking the aggregate signal, these division factors t are so chosen that the point of separation between the upper sidebands 12' and 12'' (see line d of FIG. 3) always remains within the band-width 19' of the band filter 19. It is also possible to vary the carrier frequency $f_2$ in time in such a way that the point of separation between the lower sidebands 12a and 12b (see line d of FIG. 3) appears within the band-width 19' of the band filter 19. In this case, the transmission signal is then transmitted in normal position.

The carrier frequencies $f_1$ and $f_3$ necessary for feeding the first modulator 14 and the third modulator 20, and the frequencies of 4 Mc/s, 200 kc/s, and 25 kc/s needed for feeding the controllable frequency divider 104 and the mixer 102, are supplied by a further frequency divider 107, which is connected in turn to a preferably crystal-controlled master generator 108 which puts out a frequency of 8 Mc/s, for example. Furthermore, the frequency divider 107 also supplies the clock pulses necessary for operating the ciphering generator 106 and the shift clock pulses needed for operating the delay lines, in the form of shift registers, of the filters 33 and 34 and of the delay circuit 36.

In order that the installation of FIG. 14 may operate faultlessly, it is necessary that the control signals s in the transmitting station and in the receiving station correspond to one another, i.e., that they be identical, but shifted with respect to one another by the average time delay of the signals over the transmission channel 3.

The control signal s is not transmitted over the transmission line 3 because in it is contained the code key for unscrambling the message. The control signal s is generated both at the transmitting end and at the receiving end by the ciphering generator 106. Such a ciphering generator is described, for example, in U.S. Pat. No. 3,678,198. If the code-key pulse sequences are generated in the ciphering generators 106 at the transmitting and receiving ends in exactly the same way in identically constructed code-key pulse generators whose programs are determined by their initial state, then conformity of these initial states can be achieved in accordance with the principle described in U.S. Pat. No. 3,291,908.

The ciphering generator 106 comprises a first input 109 for introducing the master code key which is stored in a master code-key memory 110, and a second input 111 for introducing a supplementary code key. The master code key can be varied by means of a keyboard symbolized by a single key 112. Naturally, the master code-key setting must be the same at both of the cooperating stations. Before each transmission, i.e., preferably after each change of direction, the supplementary code-key, which is generated in a supplementary code-key generator 113, is transmitted from the transmitter station to the receiving station in the manner which will now be described.

Upon actuation of a speaking key 114, a control device 115 is switched on, which delivers a start signal to a command unit 117 over a line 116. Controlled at the same time over output lines, of which only one 118 is represented for the sake of simplicity, are a relay (not shown) which actuates the TR switches 90*a*–90*f*, symbolically represented electronic switches 120 and 121, and an electronic switch 119. Also for the sake of simplicity, the quintuple, parallel, electronic switch 120 for the control signal s is represented in FIG. 14 by a single switch. Triggered by the start signal, the command unit 117 produces a digital sync command which is, for example, a pulse sequence of 63 bits. The sync command travels from the command unit 117 over the electronic switch 121 to a series-to-parallel converter 122 and further over the quintuple parallel electronic switch 120 and a five-wire line 123 to the inputs 105 of the controllable frequency divider 104. The parallel binary signals arriving at these outputs 105 influence the division factor t of the controllable frequency divider 104, the division factor t amounting to 168, for example, when a binary "0" is present at the output of the command unit 117, and to 172, for example, when a binary "1" is present at the output of the command unit 117. The carrier frequency $f_2$ supplied to the second modulator 17 is 198.810 kc/s in the first case and 198.256 kc/s in the second case. These carrier frequencies are within the pass band of the band filter 19. In order for these frequencies to appear at the output of the modulator 17, a DC voltage is supplied to the input of the modulator 17 via the electronic switch 119 and the junction box 13, whereby the symmetry of the modulator 17 is disturbed and the carrier frequency $f_2$ is no longer suppressed.

The above-mentioned carrier frequencies $f_2$ are supplied alternately and as a function of the sync command to the third modulator 20, where they are converted into AF signals $f_a = 1190$ c/s and $f_b = 1744$ c/s, for example. The AF signals $f_a$ and $f_b$ serving for the command transmission are produced as described above by simple means within the F-unit or $F^{-1}$ unit so that no additional devices are necessary for producing these AF signals. They then reach the adapting network 96 directly over the line 95 and are thereafter transmitted to the opposite station over the transmission channel 3'. The sync command produced by the command unit 117, besides reaching the controllable frequency divider 104, reaches a command detector 124 of the transmitting station via the electronic switch 121 and the reversed TR switch 90*f*. The AF signals $f_a$ and $f_b$ received by the opposite station over the transmission channel 3' are there supplied via the adapting network 97 to a dual-frequency signal receiver 125 which converts the two AF signals back into a binary signal sequence. This signal sequence, which corresponds to the sync command of the command unit 124 of the transmitting station, is supplied to the command detector 124 of the receiving station over the TR switch 90*f*. On the basis of the sync command received, the command detectors of the transmitting and receiving stations each produce a sync pulse which reaches the corresponding frequency divider 107 over a line 126 in order to effect phase conformity of the clock pulses produced by the two sync pulses.

As soon as the sync pulse also arrives at the control device 115 of the transmitting station over the line 126, the electronic switch 121 is actuated. As a result, the supplementary code-key generator 113 is applied via this switch 121 to the input of the series-to-parallel converter 122. The signal sequence generated by the supplementary code-key generator 113, representing the supplementary code key, may, for example, comprise 21 bits and is preferably sent out three times. From the series-to-parallel converter 122, this signal sequence is supplied to the controllable frequency divider 104 in the same way as described above with reference to the sync command and is transmitted to the opposite station in the same manner. The signal sequence representing the supplementary code key reaches the command detector 124 of the transmitting station and the command detector 124 of the receiving station as is explained above with reference to the sync command. From the command detectors 124, the supplementary code key than arrives in the corresponding ciphering generator 106 over the second input 111. By transmitting the signal sequence representing the supplementary code key a number of times and comparing the received signal sequences with one another, any possible transmission errors can be eliminated.

After the supplementary code key has been transmitted three times, for instance, the control device 115 switches the electronic switches 120 and 121 back into the position shown in FIG. 14 and switches the electronic switch 119 off. As a result, the inputs 105 of the frequency divider 104 are applied to a another series-to-parallel converter 127 connected to the ciphering generator 106. The ciphering generator 106 is started over a line 128. Its initial position is precisely defined by the master code key given by the master code-key memory 110, on the one hand, and by the supplementary code key received from the command detector 124, on the other hand. From this moment on, the ciphering generators 106 of the transmitting and receiving stations generate the control signal s which is supplied via the electronic switches 120 to the inputs 105 of the controllable frequency divider 104. The starting times of the ciphering generators are shifted with respect to one another by the time delay of the transmission channel 3'.

Further commands may be transmitted from the transmitting station to the receiving station in the same way for controlling the operation, e.g., a response command when the speaking key 114 is released. The above-described synchronizing operation and the transmission of the signal sequence corresponding to the supplementary code key are preferably carried out at the beginning of the speech transmission upon each change of the transmitting direction. To keep the expense down, no post-synchronization preferably follows during the uninterrupted speech in one direction. Thus the maximum possible uninterrupted duration of speech in the same direction is dependent upon the stability of the master generators 108 used.

The response command is likewise produced by the command unit 117, called upon to do so by the control device 115. The response command is transmitted to the opposite station in the same way as the sync command and is received by the command detector 124 there. The latter than delivers a response pulse over a line 129 to the control device 115 of the opposite station and causes the latter to initiate the above-described operations like the transmission of the sync command and the supplementary code key in the opposite direction.

When the exchange of information has been terminated, the command unit 117 is caused by the control device 115 to produce an end-of-transmission command which is transmitted to the opposite station in the same way as the sync command. The end-of-transmission command is received by the command detectors 124 of the receiving and transmitting stations, whereupon a pulse reaches the respective control devices 115 on a line 130. The control device 115 then ensure that the two stations are shut down.

In the installation described above with reference to FIG. 14, only a carrier frequency supplied to one of the modulators of the F-unit or $F^{-1}$-unit is varied by the control signal s. As already mentioned, however, the parameters of the time-scrambling may also be varied in time for increasing the cryptological security. When the T- or $T^{-1}$-units contain analog or digital shift registers, as is the case in the embodiment illustrated by FIGS. 12 and 13, the comb-filter characteristic or the delay time $\tau$ may easily be influenced by changing the sampling frequency $f_t$ by which the shift registers are controlled. The sampling frequency $f_t$ is preferably changed in time by a second control signal derived from the ciphering generator 106. A signal statistically independent of the first control signal s may also be used as a second control signal. In a preferred embodiment, the sampling frequency $f_t$ is switched between discrete values at fixed intervals by the second control signal. When the sampling frequency is switched at short intervals, it is expedient to reverse the order of the high-pass filter 39 and the delay circuit 42 of the $T^{-1}$-unit as compared with FIG. 6. When the sampling frequency $f_t$ is switched in the transmitter and the receiver, the signal delay in the filters 33, 34, 39, 40 and in the delay circuits 36 and 42 is to be taken into account.

It would be conceivable in principle to carry out the frequency-scrambling with the aid of the F-unit 7 in the transmitter station 2 and only thereafter the time-scrambling with the aid of the T-unit 6, and first to cancel the time-scrambling with the aid of the $T^{-1}$-unit 9 in the receiving station 4 and then the frequency-scrambling with the aid of the $F^{-1}$-unit 8. With such an installation, however, there would no longer be the advantage which exists with the installation described above, viz., substantially increased difficulty in deciphering even when the T-unit has fixed parameters.

What is claimed is:

1. A method for the masked or scrambled transmission of spoken information over a telephone channel with the aid of control signals generated at the transmitting end and at the receiving end which comprises the steps of:

(a) dividing the original speech band at the transmitting end into at least two first spectral sub-bands,
(b) delaying one of said sub-bands in time with respect to the other sub-band,
(c) adding the signals of said sub-bands up to provide an aggregate signal,
(d) dividing said aggregate signal by means of a plurality of modulation operations into at least two second complementary sub-bands,
(e) interchanging the relative position of said second sub-bands within the band-width of said aggregate signal,
(f) controlling the ratio of the width of said second sub-bands by said control signal generated at the transmitting end,
(g) transmitting said second interchanged sub-bands as a transmission signal over the telephone channel,
(h) subjecting said transmission signal at the receiving end to the same modulation operations as the aggregate signal at the transmitting end,
(i) dividing the aggregate signal thereby recovered at the receiving end into said at least two sub-bands,
(j) delaying said other sub-band in time with respect to said one sub-band, and
(k) adding said delayed and undelayed sub-bands thereby to form a signal which is at least similar to the original speech signal.

2. A method in accordance with claim 1, wherein the aggregate signal is modulated by a first carrier frequency and the upper sideband of the first modulation is added to the original band of the aggregate signal, the original band and the added upper sideband are modulated by a second, step-variable carrier frequency dependent upon the control signal, a portion of the upper sideband shifted by the first modulation and the complementary portion of the original band of the aggregate signal transposed by the second modulation are filtered out of the lower or upper sideband of the second modulation, and these sub-bands are modulated by a third carrier frequency to produce a modulation product of the said interchanged sub-bands within the bandwidth of the telephone channel and in normal or inverted position.

3. A method in accordance with claim 2, wherein a dual frequency signaling is used for the transmission of system commands, which is produced by changing the divisor of a frequency division as a function of the control signal.

4. A method in accordance with claim 1 wherein the aggregate signal is modulated by a first carrier frequency, the lower sideband is filtered out and simultaneously modulated by two carrier frequencies dependent upon the control signal, the difference between said two carrier frequencies corresponding to the bandwidth of the speech band to be transmitted, and that the said second interchanged sub-bands are filtered out of the lower or upper sideband of this double modulation and are subjected to further modulation by the first carrier frequency to produce the modulation product of the said second interchanged sub-bands within the band-width of the telephone channel in normal or inverted position.

5. A method in accordance with claim 4, wherein a dual-frequency signaling is used for the transmission of system commands, which is produced by changing the divisor of a frequency division as a function of the control signal.

6. A method in accordance with claim 1, wherein the said first sub-bands are formed with the aid of a low-pass filter and a complementary high-pass filter, the pass bands of which do not overlap.

7. A method in accordance with claim 1 wherein the said first sub-bands are formed with the aid of two comb-filters the pass bands of which intermesh.

8. A method in accordance with claim 7, wherein the pass bands of the comb-filters and the delay of the said one first sub-band with respect to the said other first sub-band is step-varied in time with the aid of a further control signal generated at the transmitting end and at the receiving end.

9. A method in accordance with claim 8, wherein the formation of the said first sub-bands and the delaying are carried out with the aid of digital or analog shift registers, and the shift frequency for the shift registers is step-varied in time with the aid of the said further control signal.

10. A method in accordance with claim 9, wherein the time-variable shift frequency is produced by changing the divisor of a frequency division as a function of the said further control signal.

11. A method in accordance with claim 3, wherein the two frequencies necessary for the command transmission are produced by alternately supplying to the modulator fed with the carrier frequency dependent upon the control signal-two-carrier frequencies within the pass band of the band filter inserted after the modulator and making this modulator asymmetrical during the command transmission.

12. An installation for the masked or scrambled transmission of spoken information over a telephone channel with the aid of a control signal, comprising two ciphering generators, one at the transmitting end and one at the receiving end, said ciphering generators each being controllable by a master generator for generating the control signal, further comprising at the transmitting end a filter device for filtering out at least two first sub-bands from the original speech band, a delay circuit for delaying the one sub-band with respect to the other sub-band, a device for adding up the signals of the said first sub-bands and for forming an aggregate signal, and a modulating means for producing two interchanged, complementary second sub-bands, lying within the band-width of the telephone channel, with variable ratio of the sub-band widths, and for generating the transmission signal for the telephone channel, and further comprising at the receiving end a demodulating means for converting the transmission signal into the said aggregate signal, a filter device for dividing the recovered aggregate signal into the said at least two first sub-bands, a delay circuit for the delaying the said other first sub-band with respect to the said one first sub-band, and a device for adding up the signals of the said first sub-bands and for forming a signal which is at least similar to the original speech signal.

13. An installation in accordance with claim 12, the modulation and demodulation means each comprising a first modulator for shifting the aggregate signal band into a band adjacent to the intitial band, a means for adding the original band of the aggregate signal and the shifted aggregate signal band, a step-controllable device responsive to the control signal for producing a carrier frequency for the second modulator, a band filter connected to the output of the second modulator for filtering out a portion of the singly shifted aggregate signal band and the complementary portion of the doubly shifted aggregate signal band, and a third modulator connected to the output of the said band filter for shifting the second sub-bands in normal or inverted position into the transmission band of the telephone channel.

14. An installation in accordance with claim 10, the modulation and demodulation means each comprising a first modulator for shifting the aggregate signal band, a first band filter for filtering out one of the sidebands, a second modulator working simultaneously with two variable carrier frequencies which are shifted with respect to one another by the band-width of the first band filter, a second band filter for filtering out two interchanged, complementary sub-bands, and a third modulator for shifting the sub-bands in normal or inverted position into the transmission band of the telephone channel, said first and said third modulator being connected to the same carrier frequency, and said first and second band filters having the same pass band characteristic, further comprising an additional modulator for producing the two carrier frequencies for the second modulator, said additional modulator being supplied with a constant audio-frequency signal and a carrier frequency dependent upon the control signal so that the aggregate and differential frequencies from the constant audio-frequency and the carrier frequency dependent upon the control signal occur at the output of said additional modulator.

15. An installation in accordance with claim 12, wherein the filter devices at the transmitting and receiving ends each comprise a low-pass filter and a high-pass filter, the pass bands of the low-pass filter and of the high-pass filter do not overlap, the low-pass filter or the high-pass filter at the transmitting end is connected to the adder via the delay circuit, and the high-pass filter or the low-pass filter at the receiving end is connected to the adder via the delay circuit.

16. An installation in accordance with claim 15, wherein the filter devices at the transmitting and receiving ends exhibit intermeshed comb-filter characteristics.

17. An installation in accordance with claim 16, wherein the filter devices are transversal filters, the transverse filters and the delay circuits comprise digital or analog shift registers, and wherein devices are provided at the transmitting and receiving ends for producing a step-variable shift frequency dependent upon a further control signal for operating the shift registers.

18. An installation in accordance with claim 17, wherein the device for producing the step-variable shift frequency comprises a frequency divider, the division factor of which is a function of the said further control signal.

19. An installation in accordance with claim 17, wherein each shift register is a capacitive analog shift register having a number of capacitive storage locations for storing analog instantaneous values, sampled at the cadence of the shift frequency, of the speech signal or the aggregate signal.

20. An installation in accordance with claim 17, wherein the transverse filters each comprise a digital, multi-channel shift register, further comprising a buffer memory for sequentially withdrawing data stored in the shift register, a multiplier network connected to the output of the buffer memory for sequentially processing said data, a coefficient memory for introducing coefficients into the multiplier network, and two output memories connected to the output of the multiplier network for storing the multiplied data and for forming digital component signals corresponding to the said first sub-bands.

21. An installation in accordance with claim 20, further comprising an analog-to-digital converter for supplying the speech signal of the aggregate signal to the input of the transverse filter in digital form, and wherein the two outputs of the transverse filter at which the digital component signals appear are each adapted to be connected via a switch to a digital adder and to a digital delay circuit, respectively, and the output of the adder is connected via a further switch to a digital-to-analog converter for converting the digital aggregate signal or speech signal into the analog aggregate signal or speech signal, respectively.

22. An installation in accordance with claim 21, wherein the analog-to-digital converter comprises a binary counter and a comparator for comparing the analog sampling values with the sampling values first converted by the binary counter into digital sampling values and then converted by the digital-to-analog converter into analog sampling values, the output of the binary counter is connected to the input of the transverse filter and via the said further switch to the input of the digital-to-analog converter, and the output of the digital-to-analog converter is connected during the sampling operation to the comparator via an additional switch.

23. An installation in accordance with claim 12, wherein the transmitting and receiving ends each comprise a command unit, a command detector, and a control device acting upon the command unit and response to the command detector, and wherein TR switches are associated with each control device for switching the mode of operation from receiving to transmitting or vice versa, and electronic switching means are associated with each control device for sending out or receiving commands before and/or after the transmission of the masked or scrambled speech signals.

24. An installation in accordance with claim 23, further comprising a supplementary code-key generator and a switch adapted to be actuated by the control device for transmitting a command produced by the command unit in the form of a binary pulse sequence or for transmitting a supplementary code key produced by the supplementary code-key generator in the form of a binary pulse sequence.

25. An installation in accordance with claim 24 further comprising a device for the alternate supplying to a modulator of the modulation means of two carrier frequencies corresponding to the binary pulse sequences, said carrier frequencies being within the pass band of a band filter inserted after the said modulator, and a means responsive to the control device for making the said modulator asymmetrical in order to transmit said carrier frequencies to said modulator output.

26. An installation in accordance with claim 25, wherein the device for supplying the carrier frequencies to the modulator comprises a controllable frequency divider having a number of inputs for the parallel supplying of the control signals or the command signals, further comprising a first series-to-parallel converter for converting the binary pulse sequence generated by the ciphering generator and a second series-to-parallel converter for converting the binary pulse sequence generated by the command unit or the supplementary code-key generator into the control signal or the command signal.

* * * * *